US005967038A

United States Patent [19]

Feller

[11] Patent Number: 5,967,038

[45] Date of Patent: Oct. 19, 1999

[54] FORM CYLINDER WITH ADDITIONAL TOOTHED BELT DRIVE

[75] Inventor: Bernhard Feller, Friedberg, Germany

[73] Assignee: MAN Roland Druckmaschinen AG, Offenbach am Main, Germany

[21] Appl. No.: 09/208,389

[22] Filed: Dec. 9, 1998

[30] Foreign Application Priority Data

Dec. 9, 1997 [DE] Germany ..... 197 54 544

[51] Int. Cl.[6] ..... B41F 13/24

[52] U.S. Cl. ..... 101/247; 101/218

[58] Field of Search ..... 101/247, 177, 101/185, 193, 209, 217, 218

[56] References Cited

FOREIGN PATENT DOCUMENTS 28 35 960 8/1979 Germany .

43 03 872C2 8/1995 Germany .

2 027 841 2/1980 United Kingdom ..... 101/247

*Primary Examiner*—Edgar Burr

*Assistant Examiner*—Darius N. Cone

*Attorney, Agent, or Firm*—Cohen, Pontani, Lieberman & Pavane

[57] ABSTRACT

The invention provides a rotary printing machine having a form cylinder movable between an on and an off position mounted in a rotary printing machine. The form cylinder cooperates with a transfer cylinder or directly with a back-pressure cylinder (7) to print a printing material. In addition to driving gearwheels the printing machine has a positively power introducing drive band, for example a toothed belt, which transmits the drive power from the back-pressure cylinder or the transfer cylinder to the form cylinder. In the off position, the form cylinder is driven solely by the drive band.

5 Claims, 1 Drawing Sheet

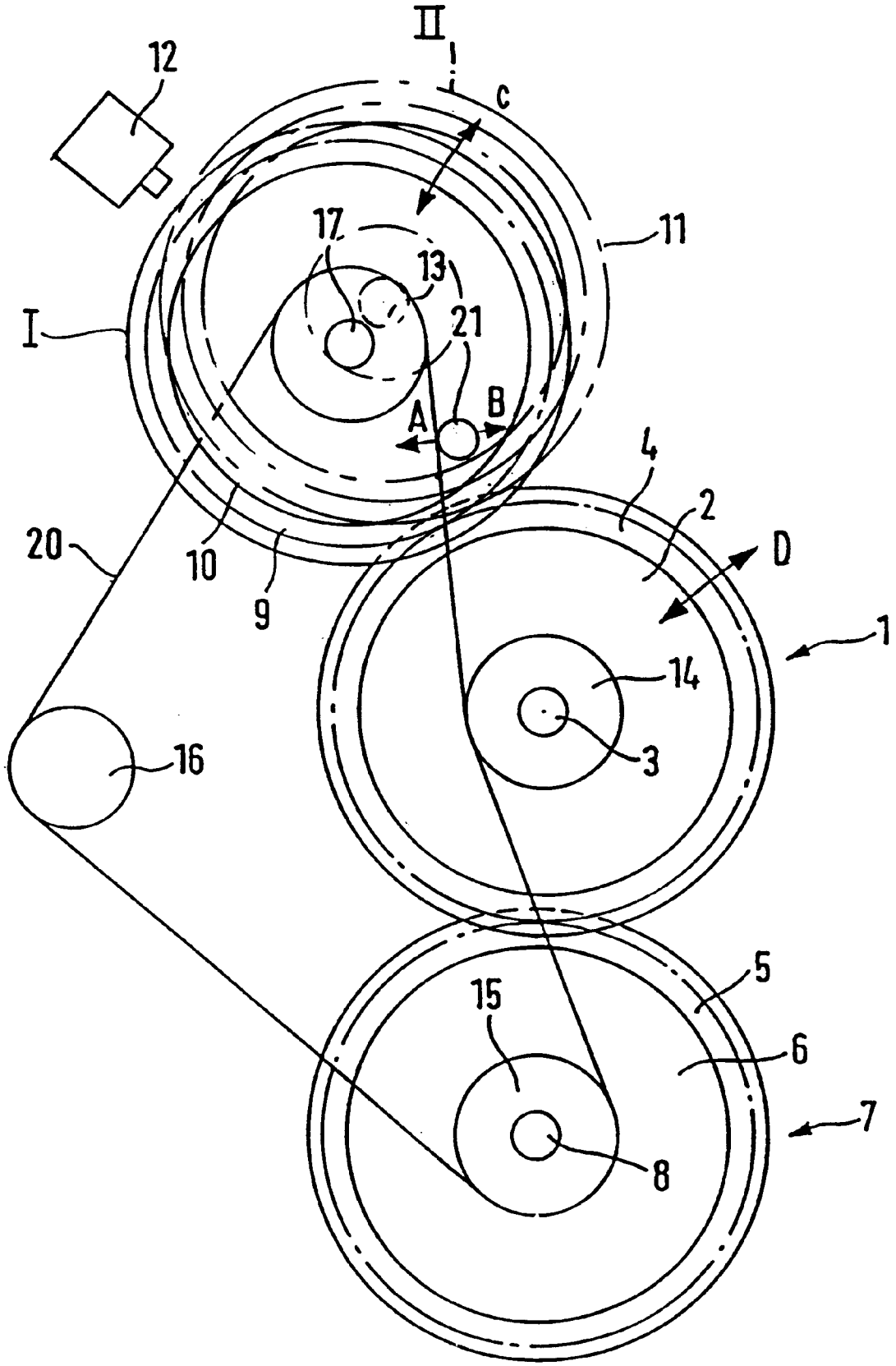
II
12
C
17
13
11
I
21
A
B
4
2
20
10
D
9
1
14
3
16
5
15
6
7
8

FORM CYLINDER WITH ADDITIONAL TOOTHED BELT DRIVE

BACKGROUND OF THE INVENTION

1. Field of the Invention

The present invention relates to a rotary printing machine with a form cylinder and another cylinder each having a gearwheel. The form cylinder is movable between an on position and an off position. The gearwheel of the other cylinder engages the gearwheel of the form cylinder when the form cylinder is in the on position so that the other cylinder drives the form cylinder. The rotary printing machine also includes an imaging device for imaging the form cylinder while the form cylinder is in the off position. The gearwheels are either partially engaged or disengaged when the form cylinder is in the off position.

2. Description of the Related Art

German reference DE 43 03 872 C2 discloses a prior art rotary printing machine with a form cylinder that can be imaged within the rotary printing machine such, for example, as by a laser writing system or a thermal writing system.

In printing machines which are driven by gearwheels via a wheel train, imaging is performed on the form cylinder when the form cylinder is pivoted or otherwise positioned away from the transfer cylinder to all off position and the transfer cylinder is also pivoted or moved away from a back-pressure cylinder to an off position. The pivoting results in a gap, the order of magnitude of which is a few tenths of a millimeter or several millimeters, that is large enough so that the form cylinder and transfer cylinder and the transfer cylinder and back-pressure cylinder do not touch one another. The transfer cylinder and back-pressure cylinder must also no longer touch the printing material in the off position. In embodiments which do not include a transfer cylinder, the form cylinder is driven by the back-pressure cylinder and the back-pressure cylinder must not touch the form cylinder or the printing material when the form cylinder is in the off position.

When the form cylinder is in the on position, the necessary pressure force between the form cylinder and transfer cylinder is achieved by a rubber coating of the transfer cylinder (rubber blanket cylinder). When the form cylinder is in the on position on the back-pressure cylinder, the latter must carry a corresponding rubber coating to achieve the necessary pressure force. To achieve sufficient pressure force, the form cylinder must be pressed against the other cylinder so firmly together that a slight deformation of the cylinders occurs in the region of the contact zone. Cylinder interference is of the order of magnitude of 0.2 mm. Therefore, to achieve sufficient clearance between the cylinders when the form cylinder is moved to the off position, the form cylinder is required to move a distance of 0.2 mm plus a few tenths of a millimeter as a safety reserve.

For an optimum printing cycle, it is necessary for the gearwheels, which are arranged on a lateral side of the cylinder bodies on the form cylinder, transfer cylinder or back-pressure cylinder, to roll optimally one on the other in a fully meshed engagement when the cylinders are in the on position. When the cylinders are moved to the off position, the gearwheels are not in full meshed engagement and have increased tooth play, thereby causing the gearwheels to roll unfavorably one on the other insofar as the gearwheels still touch one another. If the gearwheels are fully disengaged when the cylinders are in the off position, the top portions of the teeth of the two gearwheels may abut one another during an attempt to return to the on position which may prevent the cylinders from fully moving to the on position or cause damage to the gearwheels. The form cylinder is normally required to be in the off position during imaging. Because of the uncontrolled movement cycles of the two adjacent gearwheels in relation to one another caused by the tooth play when the cylinders are in the off position, and because of the unfavorable rolling of the toothed flanks when the gearwheels still touch one another, rotational speed wobbles occur when the form cylinder is in the off position which impair the image quality when the form cylinder is imaged within the printing machine. Imaging operations are particularly sensitive to rotational speed fluctuations when the rotational speed fluctuations are of higher frequency such, for example, as have a frequency of more than ten Hz. The control of the imaging device cannot follow such rapid rotational speed fluctuations. At a typical circumferential speed such for example, as 0.5 m/s, these fluctuation frequencies may lead to streaking in spatial frequency ranges in which the human eye is particularly sensitive. With the circumferential speed of 0.5 m/s and a rotational speed fluctuation with a frequency of 100 Hz, the resultant imaging fluctuations would occur in a region of 5 mm in the direction of printing which would be easily detectable. Thus, even slight density fluctuations, for example of the order of magnitude of 1%, which are caused by the rotational speed fluctuations, may lead to visible streaking. In contrast, low frequency rotational speed wobbles are not critical because the imaging control can easily follow slow changes in rotational speed and density fluctuations with low spatial frequencies such, for example, as those which occur within a length of several centimeters cannot be easily detected by the human eye.

It is already known from German reference DE 28 35 960 B1 to damp oscillations which may occur in the gearwheel drive mechanism of rotary printing machines. In the drive of the impression cylinders in this reference, at least two gearwheels forming a first power transmitting drive train are connected to a second power transmitting drive train in parallel using a belt. The belt is a flat or vee belt which is capable of slipping and is therefore not a sufficient means for eliminating the undesirable tooth flank play when the cylinders are in the off position.

SUMMARY OF THE INVENTION

It is an object of the present invention to provide a cylinder drive which eliminates changes in rotational speed during the imaging operation to eliminate streaking and other undesirable imaging errors.

This object is achieved by a rotary printing machine with a form cylinder having a gear wheel and another cylinder having a gear wheel. The form cylinder is movable between an on position and an off position. When the form cylinder is in the on position, the form cylinder is pressed against the other cylinder and the gearwheels are fully meshed. The other cylinder drives the form cylinder via a meshed connection between the gearwheels when the form cylinder is in the on position. When the form cylinder is in the off position, the form cylinder does not touch the other cylinder and the gearwheels are either partially engaged or fully disengaged. The rotary printing machine further includes an imaging device for imaging the form cylinder when the form cylinder is in the off position. The printing machine also includes first and second drive wheels respectively mounted on the form cylinder and another cylinder and a third drive wheel rotatably mounted in the printing machine. An additional drive includes a drive band running around the first, second, and third driving wheels. The drive band and associated driving wheels are arranged such that the gearwheels are fully disengaged and the form cylinder is drivable by the drive band when the form cylinder is in the off position.

According to the invention, the form cylinder and transfer cylinder or the form cylinder and back-pressure cylinder are not only connected via gearwheels, but, at the same time, are driven via a toothed belt, so that, in the off position, the toothed belt keeps the teeth of the gearwheels staggered and contact between the flanks in the off position is thereby avoided. High frequency rotational speed wobbles having an adverse influence on the imaging operation are thereby prevented from being coupled due to the contact of the tooth flanks, since the tooth flanks do not touch one another.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The drawing shows a side view of a cylinder drive arrangement in a rotary printing machine according to the present invention.

DETAILED DESCRIPTION OF THE PRESENTLY PREFERRED EMBODIMENTS

Referring to the FIGURE, a transfer cylinder 1 which is a rubber blanket cylinder of an offset printing unit has a cylinder body 2 and is mounted via cylinder journals 3 in the side walls of the printing unit of a rotary printing machine (the remainder of the printing unit is not illustrated here). A gearwheel 4, which is driven via a gearwheel 5, is arranged on one of the ends of the cylinder body 2.

The gearwheel 5 is arranged on the end of a cylinder body 6 of a back-pressure cylinder 7. The gearwheel 5 is driven by either a further gearwheel, not illustrated here, or a drive motor drives the cylinder journals 8 of the back-pressure cylinder 7, in which case the drive motor may be designed as an internal rotor motor. Other drive possibilities may also be envisaged.

The gearwheel 4 of the transfer cylinder 1 is itself connected to a gearwheel 9 which is arranged on the end of a cylinder body 10 of a form cylinder 11. The form cylinder 11 is movable between an on position I and an off position II (the off position of the transfer cylinder is shown in broken lines. In the on position I, the gearwheel 9 meshes fully with the gearwheel 4. By means of an eccentric, not illustrated here, or by other means of adjustment, the form cylinder 11 may be moved in the direction indicated by the double arrow C toward the off position II, in which the teeth of the gearwheel 9 touch the teeth of the gearwheel 4 only in their outer region or no longer touch them at all.

An additional drive means including a toothed belt 20 having teeth on both sides and which runs over toothed belt pulleys 13, 14, 15 and 16 ensures that the form cylinder 11 can still be driven synchronously and in phase with the transfer cylinder 1 even while said form cylinder is in the off position and is being imaged, for example, by an imaging device 12. The toothed belt pulleys 13, 14 and 15 are arranged respectively next to the gearwheels 4, 5 and 9 on the cylinder journals 3, 8 and a cylinder journal 17 of the form cylinder 11. The toothed belt 20 is provided with teeth on both sides, so that cylinders adjacent to one another can run in opposite directions as a result of the appropriate arrangement of the toothed belt 20. The opposite running is necessary when a printing material web runs between the two adjacent cylinders, that is to say, for example, between the transfer cylinder 1 and form cylinder 11. The toothed belt 20 has a corresponding elasticity which is preferably just such that the toothed belt 20 is tensioned only slightly in the on position and is tensioned to ensure that the toothed belt drives the cylinders with as low a loss and as little friction as possible in the off position.

A once-only adjustment operation is performed when the printing unit is commissioned to position the toothed belt pulleys 13 and 14 in relation to the gearwheels 4 and 5 such that the teeth of the gearwheels 4 and 5 meshing with one another during printing are just staggered and do not touch one another when the form cylinder 11 moves to the off position for the imaging operation. In the region between the toothed belt pulleys 13 and 14, the toothed belt 20 has lower tension when the form cylinder 11 and transfer cylinder 1 are in the off position than when the form cylinder 11 and transfer cylinder are in the on position. However, the elasticity of the toothed belt 20 is sufficient to ensure that it contracts. If this is not so, a deflecting or pressure roller 21 may be arranged to provide proper tension in the toothed belt in the region between the toothed belt pulleys 13 and 14 when the form cylinder 11 is in the on position relative to the transfer cylinder 1 as a result of movement in the direction of an arrow A. When the form cylinder 11 and transfer cylinder 1 are in the on position, the pressure roller 21 is preferably moved simultaneously. When the form cylinder 11 is moved toward the off position, the pressure roller 21 is moved toward an arrow B, so that it releases the toothed belt 20.

Instead of the toothed belt 20, other positively acting drive bands may also be used such, for example, as a chain which cooperates with corresponding associated gearwheels or a perforated band which likewise cooperates with corresponding associated gearwheels. If the drive band 20 does not have sufficient elasticity to compensate the difference in distance between the on position and the off position of the form cylinder 11, the deflecting or pressure roller 21 may be provided to compensate for the difference in distance of the drive band in the two different positions.

Instead of the form cylinder 11 being driven by the gearwheel 4 of the transfer blanket cylinder 1, as illustrated in the drawing, the form cylinder 11 may be driven by the gearwheel 5 of the back-pressure cylinder 7 if the particular printing machine does not have transfer cylinder. In the embodiment without the transfer cylinder, the gearwheel 5 meshes directly with the gearwheel 9 of the form cylinder 11. In this embodiment, the form cylinder 11 is moved off of the back-pressure cylinder 7 when said form cylinder 11 is to be imaged.

The invention provides all additional drive for a form cylinder 11 in a rotary printing machine. The form cylinder cooperates with either a transfer cylinder 1 or directly with a back-pressure cylinder 7 to print a printing material. In addition to the driving gearwheels 4, 5, 9, a positively power-introducing drive band such, for example, as a toothed belt 20 transmits the drive power from the back-pressure cylinder 7 or the transfer cylinder 1 to the form cylinder 11. In the off position, the drive of the cylinders is ensured solely by the drive band.

The invention is not limited by the embodiments described above which are presented as examples only but can be modified in various ways within the scope of protection defined by the appended patent claims.

I claim:

1. A rotary printing machine, comprising:

a form cylinder movably mounted for moving between an on position and an off position and having a first gear wheel;

another cylinder having a second gear wheel, said first gear and said second gear being engagable when said form cylinder is in said on position such that said form cylinder is drivable by said another cylinder and said first gear and said second gear being disengaged when said form cylinder in said off position;

an imaging device for imaging said form cylinder when said form cylinder is in said off position; and first and second driving wheels respectively mounted on said form cylinder and said another cylinder, a third drive wheel rotatably mounted in said printing machine, and a drive band running around said first, second, and third drive wheels so that said form cylinder is drivable by said drive hand when said form cylinder is in said off position.

2. The rotary printing machine of claim 1, wherein said drive band comprises one of a toothed belt, at perforated band, and a roller chain.

3. The rotary printing machine of claim 1, wherein said drive band comprises a toothed belt having teeth on two opposing sides and wherein said first, second and third pulleys comprise toothed belt pulleys.

4. The rotary printing machine of claim 1, wherein said another cylinder comprises one of a transfer cylinder and a back-pressure cylinder.

5. The rotary printing machine of claim 1, further comprising a pressure roller operatively movably connected for compensating for a difference in distance which the drive band experiences when said form cylinder moves from said on position to said off position.

* * * * *